US009109612B2

(12) United States Patent
Gilmore et al.

(10) Patent No.: US 9,109,612 B2
(45) Date of Patent: Aug. 18, 2015

(54) SEALED HYDRAULIC TANK SYSTEM FOR MINING SHOVEL

(75) Inventors: Carl D. Gilmore, South Milwaukee, WI (US); Robert Weber, Wadsworth, IL (US); Perry DeCuir, Rochester Hills, MI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 102 days.

(21) Appl. No.: 13/320,589

(22) PCT Filed: Jun. 1, 2009

(86) PCT No.: PCT/US2009/003328

§ 371 (c)(1), (2), (4) Date: Nov. 15, 2011

(87) PCT Pub. No.: WO2010/140996

PCT Pub. Date: Dec. 9, 2010

(65) Prior Publication Data

US 2012/0055569 A1 Mar. 8, 2012

(51) Int. Cl.

| | |
|---|---|
| ***F17D 1/00*** | (2006.01) |
| ***F15B 1/26*** | (2006.01) |
| ***E02F 9/00*** | (2006.01) |
| ***E02F 9/08*** | (2006.01) |
| *F15B 21/04* | (2006.01) |

(52) U.S. Cl.

CPC ... *F15B 1/26* (2013.01); *E02F 9/00* (2013.01); *E02F 9/0883* (2013.01); *F15B 21/04* (2013.01); *Y10T 137/86212* (2015.04)

(58) Field of Classification Search

CPC ..... E02F 9/00; E02F 9/0883; F15B 21/04; F15B 1/26; Y10T 137/86212

USPC ..... 137/340, 561 A, 561 R, 563, 571, 574; 60/456; 220/720

See application file for complete search history.

(56) References Cited

U.S. PATENT DOCUMENTS

| | | | | | |
|---|---|---|---|---|---|
| 684,699 | A | * | 10/1901 | Lloyd | 137/571 |
| 2,178,519 | A | * | 10/1939 | Gill | 261/119.1 |
| 2,570,171 | A | * | 10/1951 | Von Kohorn et al. | 96/198 |
| 2,664,911 | A | * | 1/1954 | Thompson et al. | 137/205 |
| 2,793,005 | A | * | 5/1957 | Wagner et al. | 165/255 |
| 3,003,659 | A | * | 10/1961 | Miller | 220/722 |
| 3,517,815 | A | * | 6/1970 | Gray et al. | 210/256 |

(Continued)

FOREIGN PATENT DOCUMENTS

| | | | |
|---|---|---|---|
| JP | 08-151660 | A | 6/1996 |
| JP | 09-280201 | A | 10/1997 |

(Continued)

OTHER PUBLICATIONS

International Search Report for International Application No. PCT/US2009/003328, mail date Mar. 12, 2010, 5 pages.

*Primary Examiner* — Marina Tietjen
*Assistant Examiner* — Umashankar Venkatesan
(74) *Attorney, Agent, or Firm* — Foley & Lardner LLP

(57) ABSTRACT

A sealed hydraulic tank system for a mining shovel (10) includes an upper tank (68) and a lower tank (70). An air bladder (69) system is coupled to the upper tank to exchange air between the tank system and the bladder. The tanks include baffles (100,102,104,106,108) which filter the hydraulic fluid and which direct fluid flow along an elongated path to allow for de-aeration of the oil in the tank.

19 Claims, 7 Drawing Sheets

(56) References Cited

U.S. PATENT DOCUMENTS

| | | | | |
|---|---|---|---|---|
| 4,210,176 | A * | 7/1980 | Emming | 137/573 |
| 4,813,477 | A * | 3/1989 | Hansen et al. | 165/278 |
| 5,779,092 | A * | 7/1998 | Hehn et al. | 220/563 |
| 6,116,454 | A * | 9/2000 | Henderson et al. | 220/563 |
| 2003/0015537 | A1 * | 1/2003 | Konja | 220/563 |
| 2007/0163758 | A1 * | 7/2007 | Welsch | 165/120 |

FOREIGN PATENT DOCUMENTS

| | | | |
|---|---|---|---|
| JP | 2004-009800 | A | 1/2004 |
| JP | 2006-207862 | A | 8/2006 |
| KR | 2004-0003485 | | 1/2004 |

* cited by examiner

SEALED HYDRAULIC TANK SYSTEM FOR MINING SHOVEL

The present application is a U.S. national stage of and claims priority to and the benefit of International Application No. PCT/US2009/003328, entitled "Sealed Hydraulic Tank System for Mining Shovel," filed Jun. 1, 2009, which is incorporated herein by reference in its entirety.

FIELD OF THE INVENTION

This invention relates to mining shovels, and more particularly to a hydraulic tank system for a mining shovel.

DESCRIPTION OF THE BACKGROUND ART

Mining equipment, such as mining shovels, are a significant capital expenditure. It is important, therefore, to maximize operational time of this equipment. Mining shovels, for example, are operated almost constantly, as much as twenty-four hours a day, three hundred and sixty-five days a year. To minimize down time, it is therefore important that the equipment be suited to the environmental conditions in which the equipment operates.

The environment in which mining equipment is used, however, is extremely dirty, and includes both a significant amount of air borne dust and moisture. Because of these environmental conditions, hydraulic systems and components, which are particularly prone to contamination, are often avoided in mining shovel constructions. Hydraulic systems, however, can be very efficient, and are therefore also desirable in mining shovel applications. Accordingly, a need exists for a hydraulic system which is shielded from the operating environment, and which can therefore increase operational time and minimize the need for maintenance.

SUMMARY OF THE INVENTION

In one aspect, the present invention provides a tank system defining a fluid chamber for retaining hydraulic fluid used to control one or more hydraulic cylinder in a mining shovel. The tank system comprises an upper tank, a lower tank, coupled to the upper tank by a transfer tube, and an expansion bladder. The expansion bladder is coupled to the upper tank through an air transfer tube located exterior to the upper tank, such that air can be exchanged between the tank system and the bladder when the cylinder is activated.

In another aspect of the invention, the tank system can include a filtering system. The upper tank can include a filter for filtering hydraulic fluid, also referred to herein as oil, in the upper tank. The upper tank can also include a plurality of baffles partitioning the upper tank into a plurality of compartments, wherein at least one of the baffles includes an aperture to direct a flow of fluid through the tank. The apertures in the baffles can be offset a distance above the bottom surface of the upper tank to filter contaminants from the hydraulic fluids. The aperture in the baffle can also be larger adjacent a top surface of the tank than adjacent a bottom surface of the tank to provide a higher flow rate for the hydraulic fluid at the top of the tank than at the bottom of the tank.

In another aspect of the invention, the lower tank can comprise a plurality of baffles partitioning the lower tank into a plurality of compartments, wherein at least one of the baffles includes an aperture to direct a flow of fluid through the lower tank. The aperture in the baffle can be offset a distance above the bottom surface of the upper tank to filter contaminants from the hydraulic fluid. The aperture in the baffle can also be larger adjacent a top surface of the tank than adjacent a bottom surface of the tank to provide a higher flow rate for the hydraulic fluid at the top of the tank than at the bottom of the tank.

In another aspect of the invention, a tank system defining a fluid chamber for retaining hydraulic fluid used to control one or more hydraulic cylinder in a mining shovel is provided. The tank system includes an upper tank comprising an inlet, an outlet, and a plurality of baffles dividing the tank into compartments between the inlet and the outlet. At least one of the baffles comprises an aperture for directing a flow of hydraulic fluid between the inlet and the outlet. The tank system also includes a lower tank, fluidly coupled to the upper tank. The lower tank includes an inlet, an outlet, and a plurality of baffles dividing the tank into compartments between the inlet and the outlet. At least one of the baffles comprises an aperture for directing a flow of hydraulic fluid between the inlet and the outlet. The tank system also includes an expansion bladder, the expansion bladder coupled to the upper tank, wherein air is exchanged between the tank system and the bladder when the cylinder is activated. In some embodiments, the bladder system is exterior to the upper tank and to the lower tank, and wherein the bladder system is coupled to the upper tank through an air transfer tube.

In still another aspect of the invention, a tank system is provided defining a fluid chamber for retaining hydraulic fluid used to control one or more hydraulic cylinder in a mining shovel. The tank system includes an upper tank, a lower tank, coupled to the upper tank by a transfer tube, and a cooler system connected between the upper and lower tanks, wherein when the hydraulic cylinders are activated, hot oil is returned to the upper tank and is transmitted through the cooler system and to the lower tank.

These and still other advantages of the invention will be apparent from the description which follows. In the detailed description below, the preferred embodiment of the invention will be described in reference to the accompanying drawings. This embodiment does not represent the full scope of the invention. Rather the invention may be employed in other embodiments. Reference should therefore be made to the claims herein for interpreting the breadth of the invention.

DETAILED DESCRIPTION OF THE PREFERRED EMBODIMENTS

Figure 1:
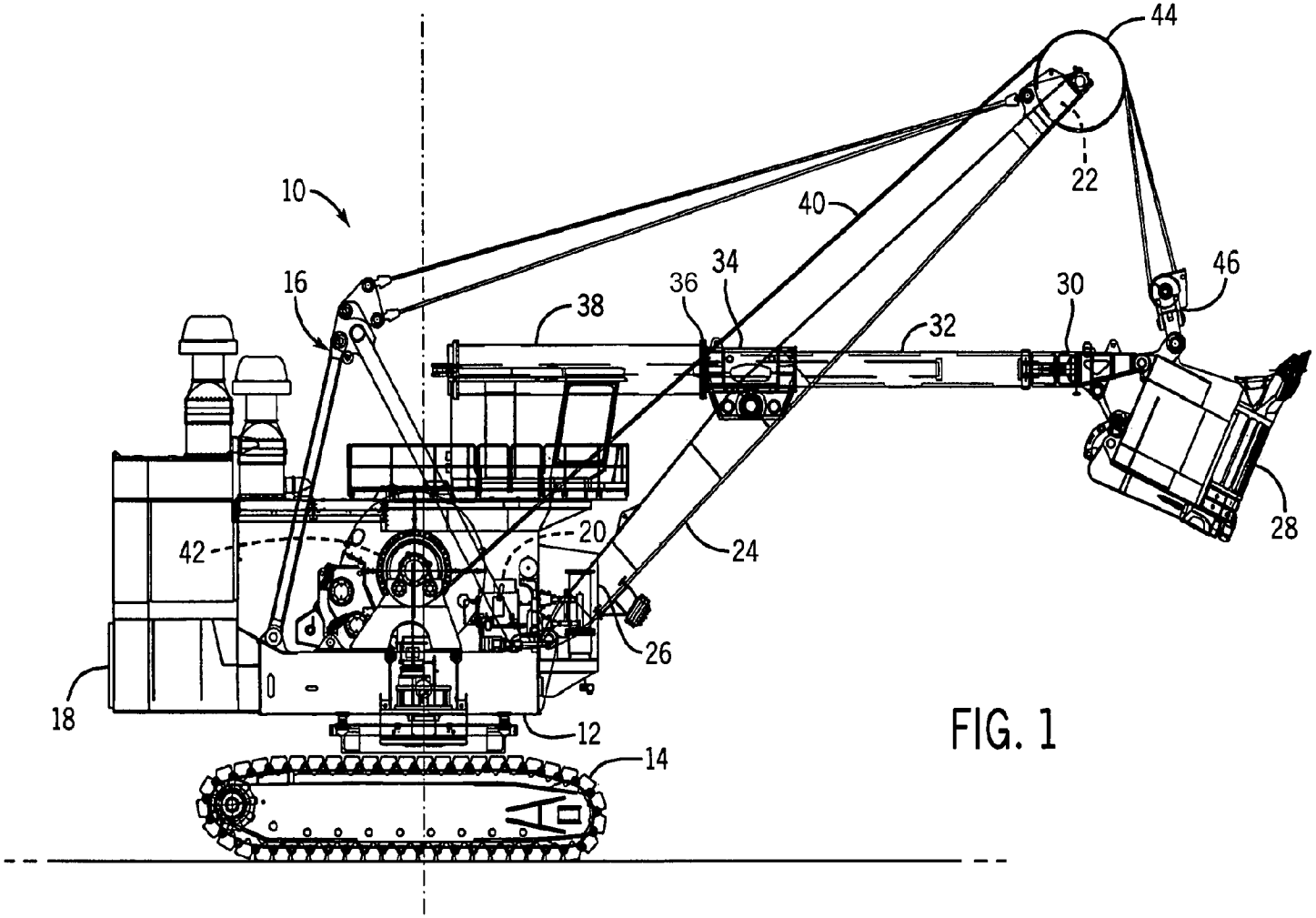
FIG. 1 is a perspective view of a mining shovel.

Referring to FIG. 1, a mining shovel 10 is shown. The mining shovel 10 includes a turntable 12 mounted on a crawler truck 14, and supporting an A-frame 16 and a cab 18. The cab houses a power unit 20, including a hydraulic control system 21 (FIG. 2), and an electrical control system that operates the mining shovel components in response to inputs from the operator and automatic devices, such as limit switches, pressure switches, temperature switches, and the like. The operator can provide inputs from within the cab 18 through manually operable devices, such as a joystick, lever, foot pedals, rocker switches, computer keyboard, touch pads, and the like.

The A-frame 16 supports a top end 22 of a boom 24, a bottom end 26 of the boom 24 being supported by the turntable 12. A dipper 28 is mounted on the front end 30 of a dipper handle 32 which is slidably supported in a saddle block 34 mounted in the boom 24. The saddle block includes a yoke 36 and a support frame 38 which projects rearwardly from the yoke 36 and encloses the back end of the dipper handle 32. The yoke 36 of the saddle block 34 is pivotally mounted in the boom 24, so as to pivot in a vertical plane. A hoist cable 40 extends upward from a powered hoist drum 42 on the turntable 12, over a sheave 44 at the top end 22 of the boom 24 and down to a padlock 46 on the dipper 28. The hoist cable 40 provides for the vertical, raising and lowering, movement of the dipper 28. A hydraulic crowd mechanism (not shown) is enclosed in the support frame 38, provides the horizontal component, or crowd, of the dipper's movement.

Figure 2:
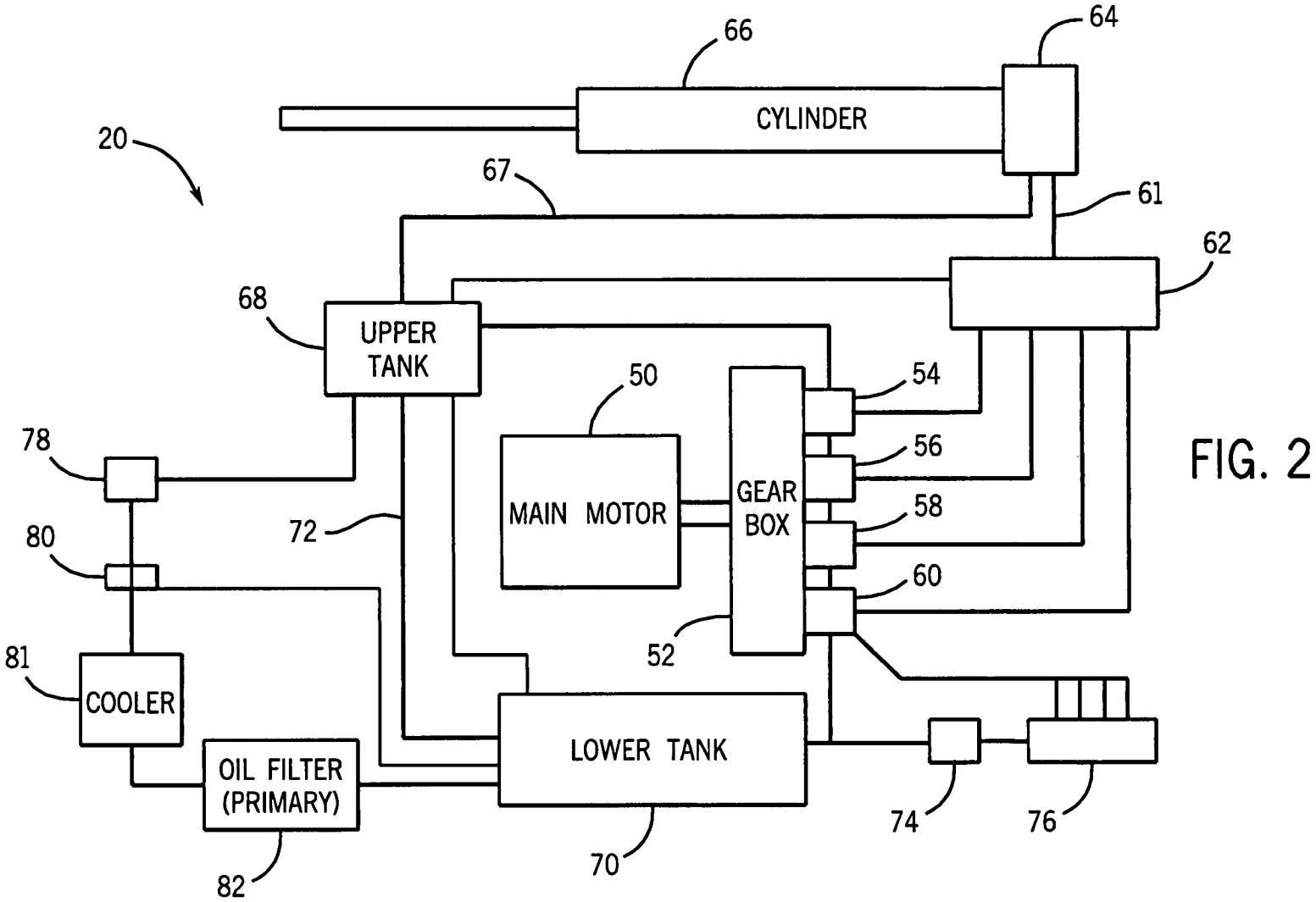
FIG. 2 is a block diagram of the hydraulic system including the tank system of the present invention.

Referring now to FIG. 2, a block diagram of the hydraulic control system 20 of the mining shovel 10 is shown. The hydraulic control system 20 includes a variable speed motor 50 that drives a gear box 52 which is coupled to four fixed displacement pumps, 54, 56, 58, and 60. The output of the pumps 54, 56, 58, and 60 is directed to a pump control manifold 62, which combines the flow from the pumps 54, 56, 58, and 60, and directs the flow through high pressure supply lines 61 to a cylinder control manifold 64. The cylinder control manifold 64 is coupled to and drives a hydraulic cylinder 66 in the hydraulic crowd control mechanism, providing directional control of the cylinder 66. Hydraulic fluid returned from the hydraulic cylinder 66 is directed through low pressure plumbing lines 67 to a hydraulic tank system that includes an upper tank 68 connected to a lower tank 70. The circuit further includes a flushing pump 74 and associated flushing manifold 76, and a circulation pump 78 and associated circulation manifold 80. A cooler 81 is also provided for maintaining the temperature of the hydraulic fluid or oil. During operation, oil is directed from the hottest location in the upper return tank 68 and to the cooler system which includes a circulation pump 78, circulation manifold 80, and cooler 81. After oil passes through the cooler 81, it passes through the primary oil filter 82, and is then returned to the lower tank 70. The cooler 81 can be, for example, a commercially-available cooling system such as the model OCS-1000 available from Young-Touchstone of Racine, Wis.

Figure 3:
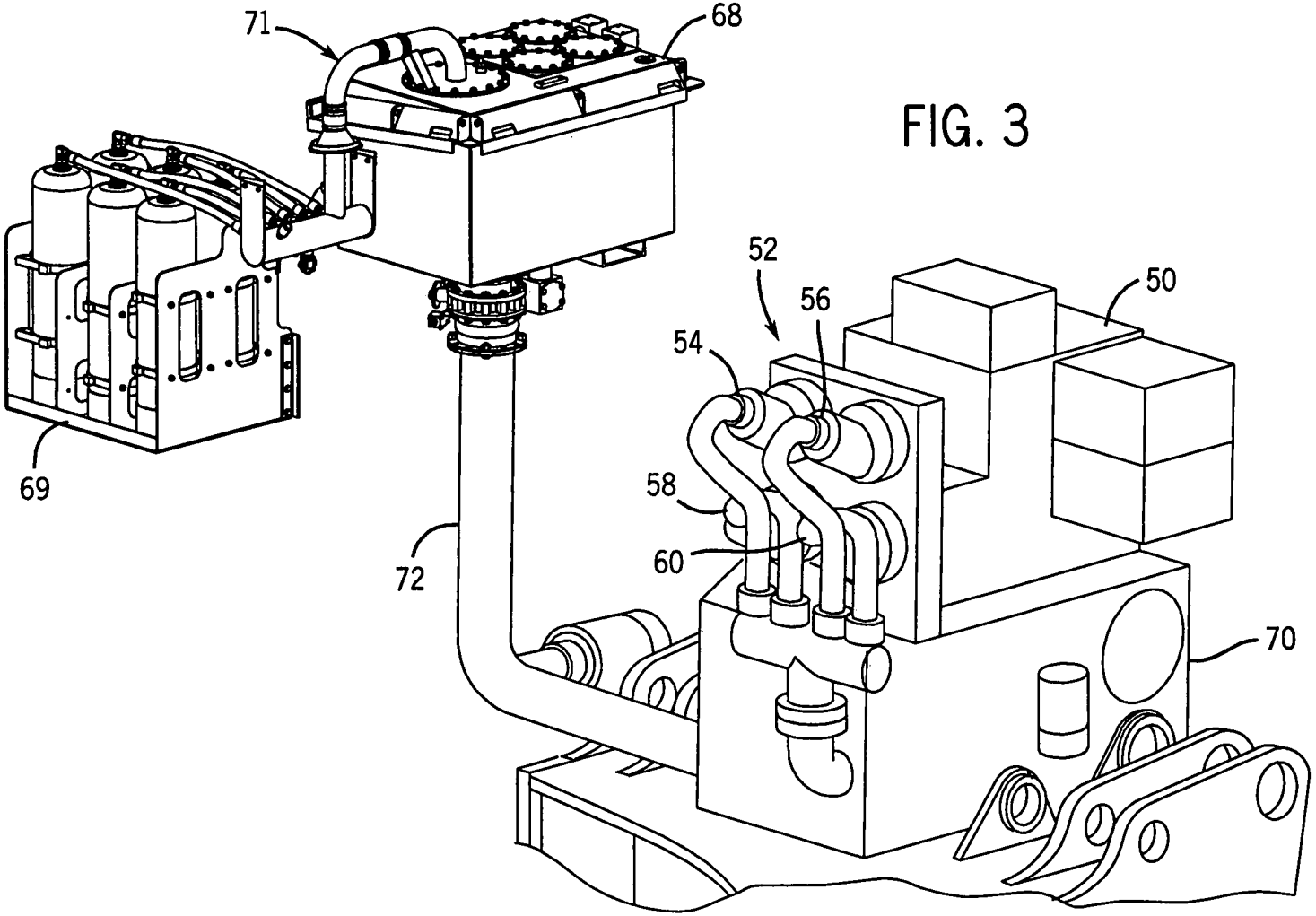
FIG. 3 is a partial perspective view of the tank system of the present invention.

Referring now also to FIG. 3, a perspective view of the sealed hydraulic system is shown. As described above, the hydraulic tank system includes both an upper tank 68 and a lower tank 70. The upper tank 68 supplies oil to the lower tank 70 through a transfer pipe 72. Because of the force of gravity from the upper tank 68, a positive head pressure is supplied at the pump inlets, and prevents cavitation to the pumps. A bank of expansion bladders 69, here comprising a bank of six flexible bladder devices, is coupled to the upper tank 68 through an air transfer tube 71. The expansion bladders 69 allow for the differential volume of oil in the reservoir and exchange of air into and out of the reservoir and bladder. Each of the bladders in the bank of expansion bladders 69 expands and contracts as air is exchanged, and is sufficiently flexible so as to not pressurize the tank system above the atmospheric pressure.

Figure 4:
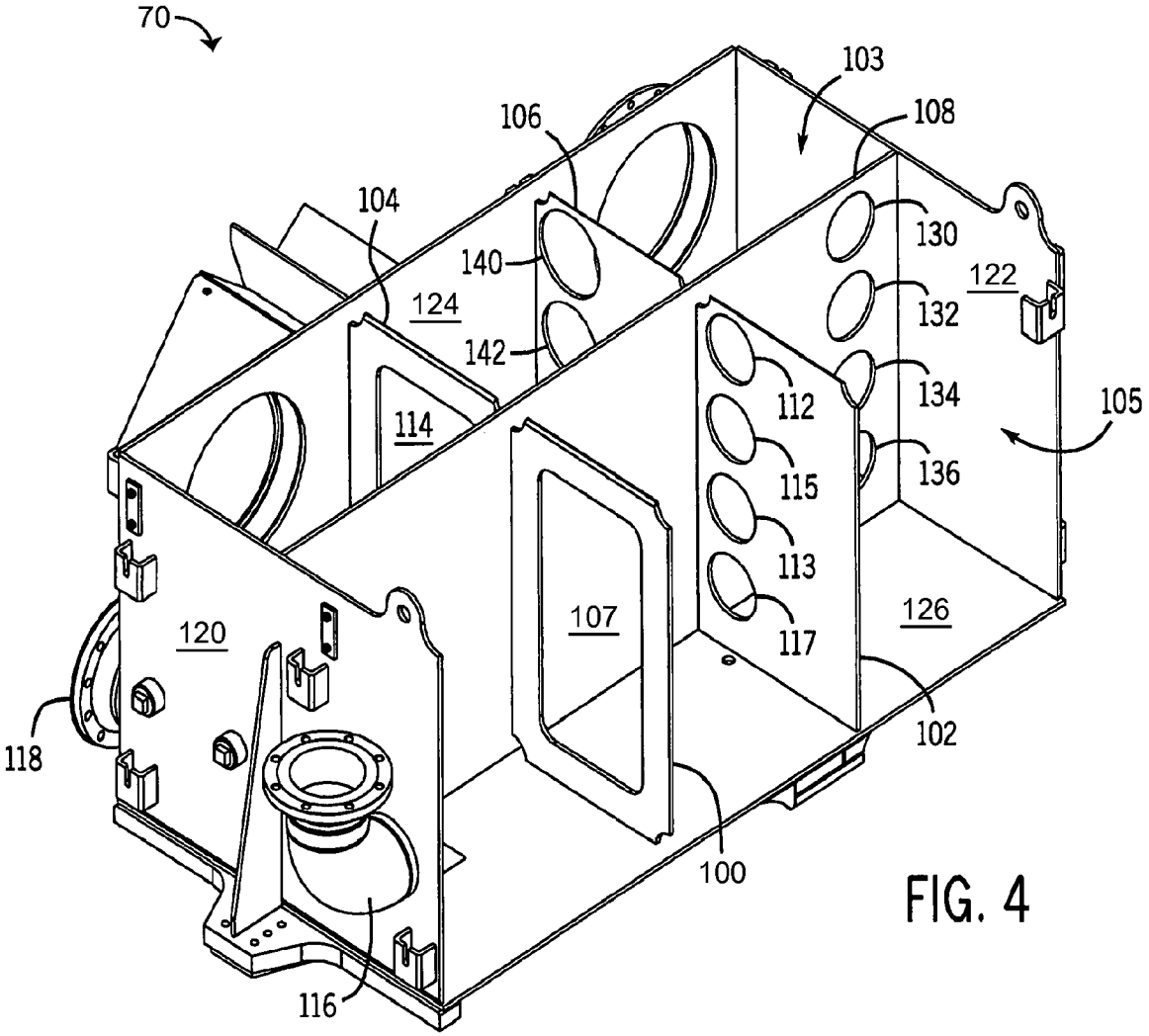
FIG. 4 is an interior view of the lower tank of the tank system of FIG. 3.

Referring now to FIG. 4 a perspective view of the interior of the lower tank 70 is shown. The tank 70 includes a rectangular bottom surface 126, opposing end walls 120 and 122, and a side wall 124. A top surface and opposing side wall have been removed in this illustration to provide a view of the interior. As described above, oil is transferred to the lower tank 70 from the upper tank 68 through the transfer pipe 72, which is connected to the tank 70 at the inlet port 118 in the side wall 124. Oil can be drawn from the tank at outlet port 116 in the end wall 120, which is connected to a suction header for the pumps 54, 56, 58, and 60. Other apertures in side wall 124 provide access points for service and maintenance, and are covered in use.

As shown here, the tank 70 is divided into a plurality of compartments by a series of baffles 100, 102, 104, 106, and 108, where the baffle 108 extends between the opposing end walls 120 and 122, and the baffles 100, 102, 104, and 106 extend between opposing side walls. The baffle 108 is substantially centered in the tank between the side walls and extends along a length of the tank 70, parallel to the side wall 124, dividing the tank 70 into two compartments 103 and 105 between the end walls 120 and 122. The compartment 103, which receives oil from the inlet port 118, is further subdivided by baffles 104 and 106, which extend in a direction substantially perpendicular to side wall 124 and toward the center baffle 108.

The baffles 104 and 106 include apertures which direct oil from the inlet 118 in side wall 124 (i.e., at or near end wall 120) to the opposing end of the tank 70 at wall 122. Baffle 104, which is positioned adjacent the inlet 118, includes an opening 114 which is substantially rectangular in shape, and which extends across a substantial portion of the baffle 104, allowing oil flow through the baffle 104, and also allowing access to the compartments for maintenance. The baffle 106 includes a series of circular apertures similar to apertures 140, 142 which extend in a linear succession from a position adjacent a top of the baffle 106 to a position adjacent a bottom of the baffle 106, and which are located adjacent the side wall 124. The center baffle 108, similarly, includes a series of apertures extending from a position adjacent the top of the tank 70 to a position adjacent the bottom surface 126. These apertures 130, 132, 134, and 136, are positioned adjacent the end wall 122, and provide a conduit for oil to move from the compartment 103 to the compartment 105, and provide a filtering function. Although the apertures are shown here as substantially equivalent in size, in some applications, the apertures can be arranged with a larger aperture adjacent the top of the baffle, and smaller apertures adjacent the bottom of the baffle. Here, a higher rate of flow is provided at the top of the tank 70, and a slower rate of flow at the bottom of the tank, which can improve the settlement of particles in the bottom of the tank 70.

The compartment 105, similarly, is subdivided by baffles 100 and 102, where baffle 102, similar to the baffle 106, includes a series of circular apertures 112, 113, 115, and 117, extending from a position adjacent the top of the baffle 102 to a position adjacent the bottom of the baffle 102, and at a side of the baffle 102 that is adjacent the center baffle 108. The baffle 100 is similar to the baffle 104, and includes a relatively large rectangular opening 107. Oil that enters the compartment 105 through the apertures 130, 132, 134, and 136 is directed by the baffles 102 and 100 to the outlet 116. Because the apertures provided in all of the baffles 100, 102, 104, 106, and 108 are positioned above the bottom surface 126 of the tank 70, large contaminants are trapped within the compartments 103 and 105 as oil flows, settling contaminants in the tank. Further, because the oil is directed through the tank 70 in a relatively large flow path, the oil has sufficient time to de-aerate while in the tank 70. As described above, the rectangular opening (e.g., openings 107, 114) allows for greater access to the compartments for maintenance, while the smaller circular apertures (e.g., apertures 112, 113, 115, 117, 130, 132, 134, 136, 140, 142) provide an improved filtering function. These apertures, as described above, can be shaped to be larger at the top and smaller at the bottom, which provides for a higher rate of flow at the top than at the bottom of the tank 70, and improved filtering. The rectangular apertures, similarly, can be constructed to be larger at the top than at the bottom, varying the rate of flow through the tank 70.

Figure 5:
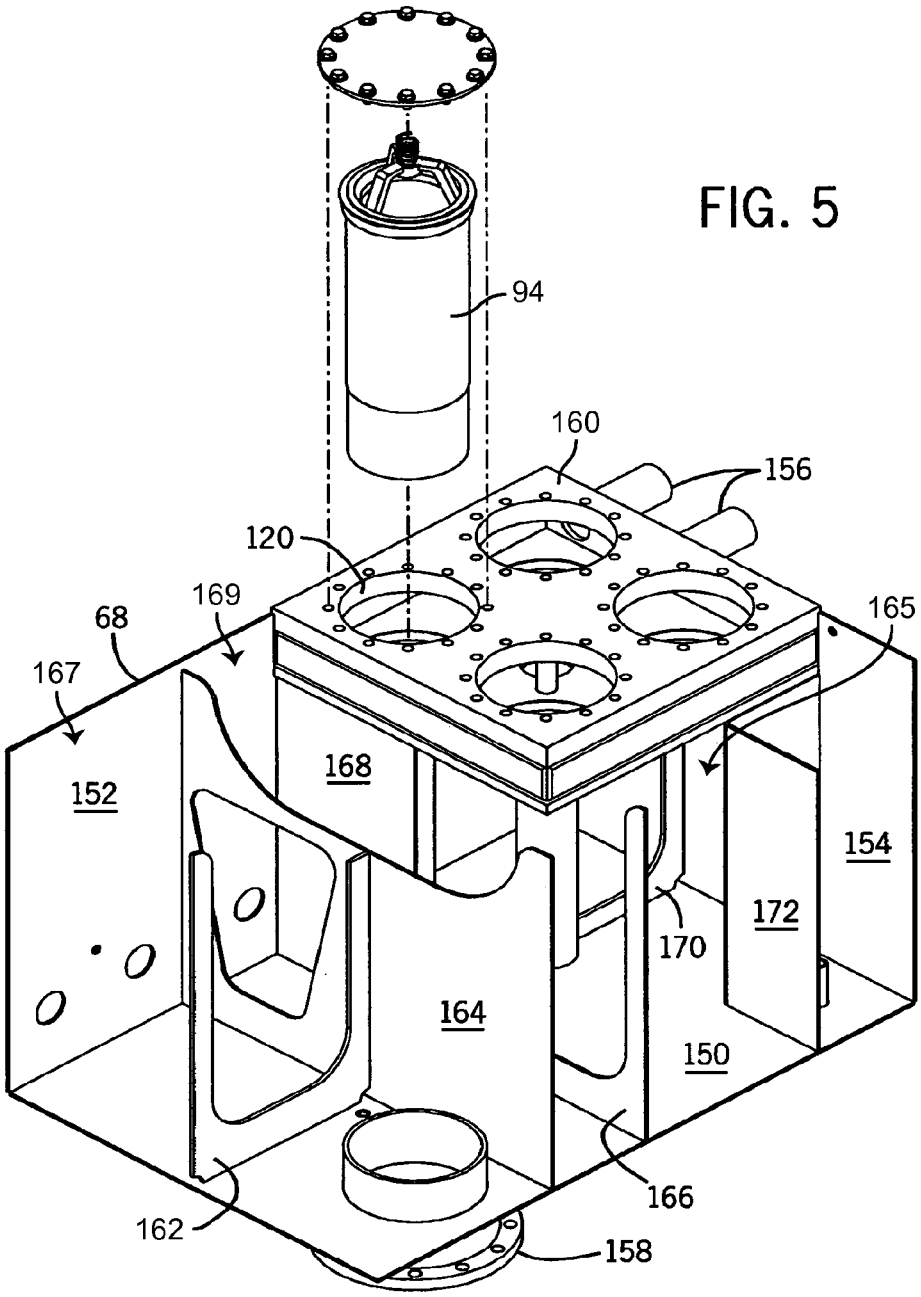
FIG. 5 is an interior view of the upper tank of the tank system of FIG. 3.

Referring now to FIG. 5, a perspective view of the upper tank 68 is shown. The tank 68 again includes a lower surface 150, end wall 154, and side wall 152. An opposing end wall, opposing side wall, and top surface are not shown to provide a view of the interior surfaces. Oil from the transfer pipe 72 is directed into one or more inlet port 156 provided in the end wall 154, and positioned adjacent a structural box 160 for retaining filter elements 94, which extend below the box 160 into the tank 70, and which are designed to remove large particles from the oil stream, and can also include magnets and other elements to remove metal components. The outlet port 158 is provided in a lower surface 150, adjacent the end of the tank 68 opposite the inlet 156. A series of baffles 162, 164, 166, 168, and 170 divide the tank 68 into compartments, and include apertures to direct the flow of oil. The apertures in the baffles are offset above the bottom surface 150 to cause solid particles to be separated from the oil, and to settle into the compartments, preventing movement of the particles toward hydraulic components, as also discussed above with reference to bank 70.

Referring still to FIG. 5, the baffles in tank 68 divide the tank into three separate compartments, an inlet compartment 165, an outlet compartment 167, and a middle compartment 169. The inlet compartment 165 is provided between baffles 166 and 168, which extend between the side walls of the tank 68, and end wall 154. The outlet compartment 167 is provided between baffle 164 and the end wall opposite end wall 154 and the baffle 164. The middle compartment 169 is provided between baffle 164 and the baffles 166 and 168, and provides a settling tank between the input and output.

Upon entry of oil into the tank 68 through inlet ports 156, the oil is filtered by filters 94, and moves into the inlet compartment 165. Inlet compartment 165 is further divided by baffle 170, extending perpendicular to baffle 168, between baffle 168 and end wall 154. The baffle 170 includes a rectangular recess that is offset above the floor 150 of the tank 68 to settle contaminants in the tank, as described above. Oil directed through the recess in the baffle 170, and then through a recess in the baffle 166, which causes the oil to turn substantially ninety degrees as it enters the middle compartment 169. Oil exits the middle compartment 169 through a recess formed in the baffle 164, which is formed in a surface adjacent the side wall 152, on the opposite side of the tank 68 from the recess formed in baffle 166, again causing the oil to turn. From the recess in baffle 164, oil is directed toward baffle 162, which extends substantially perpendicular to baffle 164 and toward the end opposite end wall 154. The baffle 162, again, includes a recess that is offset above the bottom surface 150 to settle additional contaminants. On the opposing side of the baffle 162, oil is directed through the outlet port 158, and out of the upper tank 68. The oil, therefore, is directed through a serpentine path that filters contaminants in the tank 68, and allows the oil to de-aerate. As shown here, the opening formed in baffle 164 can be larger at the top and taper downward, to provide a higher rate of flow along the top of the tank 68, and a lower rate of flow along the bottom surface of the tank 68, as discussed above with reference to tank 70. Similar constructions can be provided in other baffles.

Figure 6:
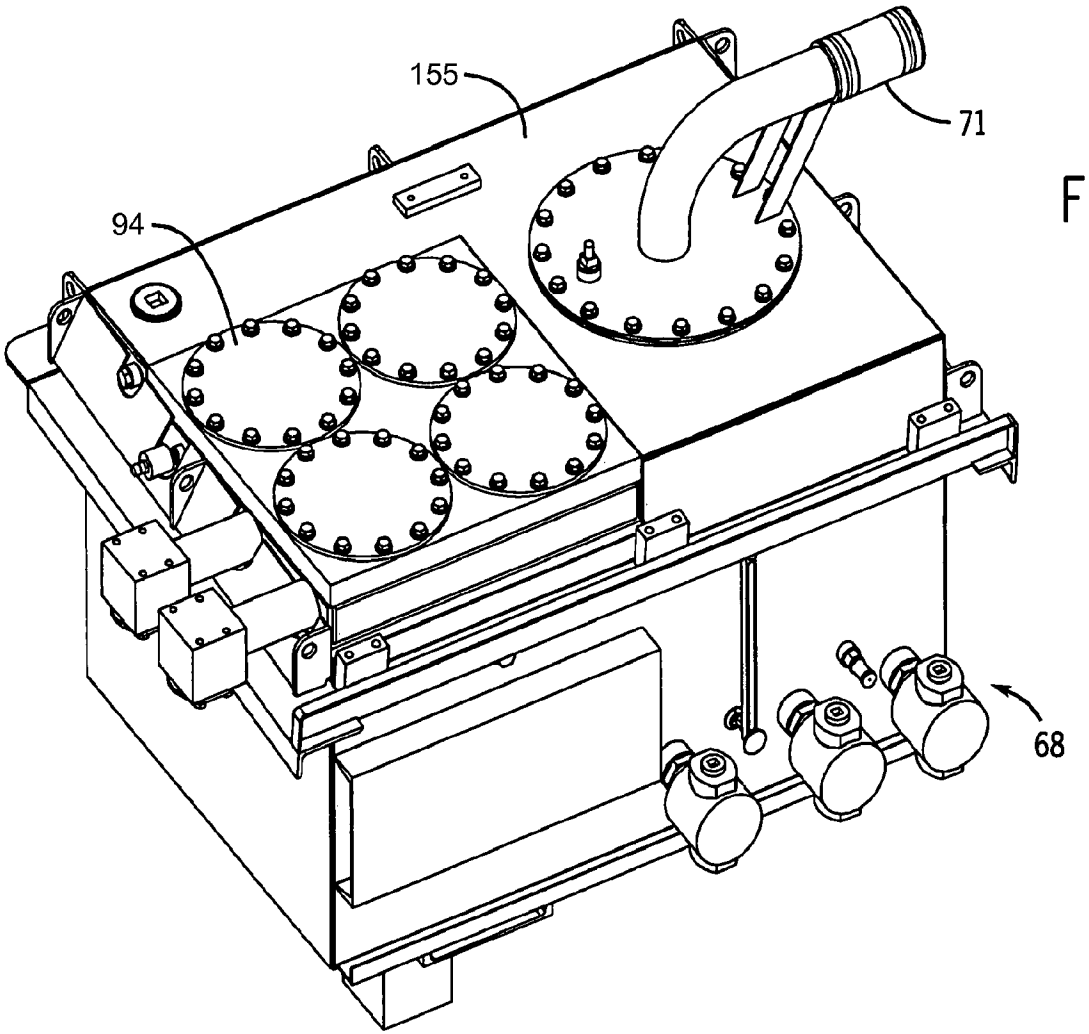
FIG. 6 is an upper perspective view of the upper tank of the tank system of FIG. 3.
Figure 7:
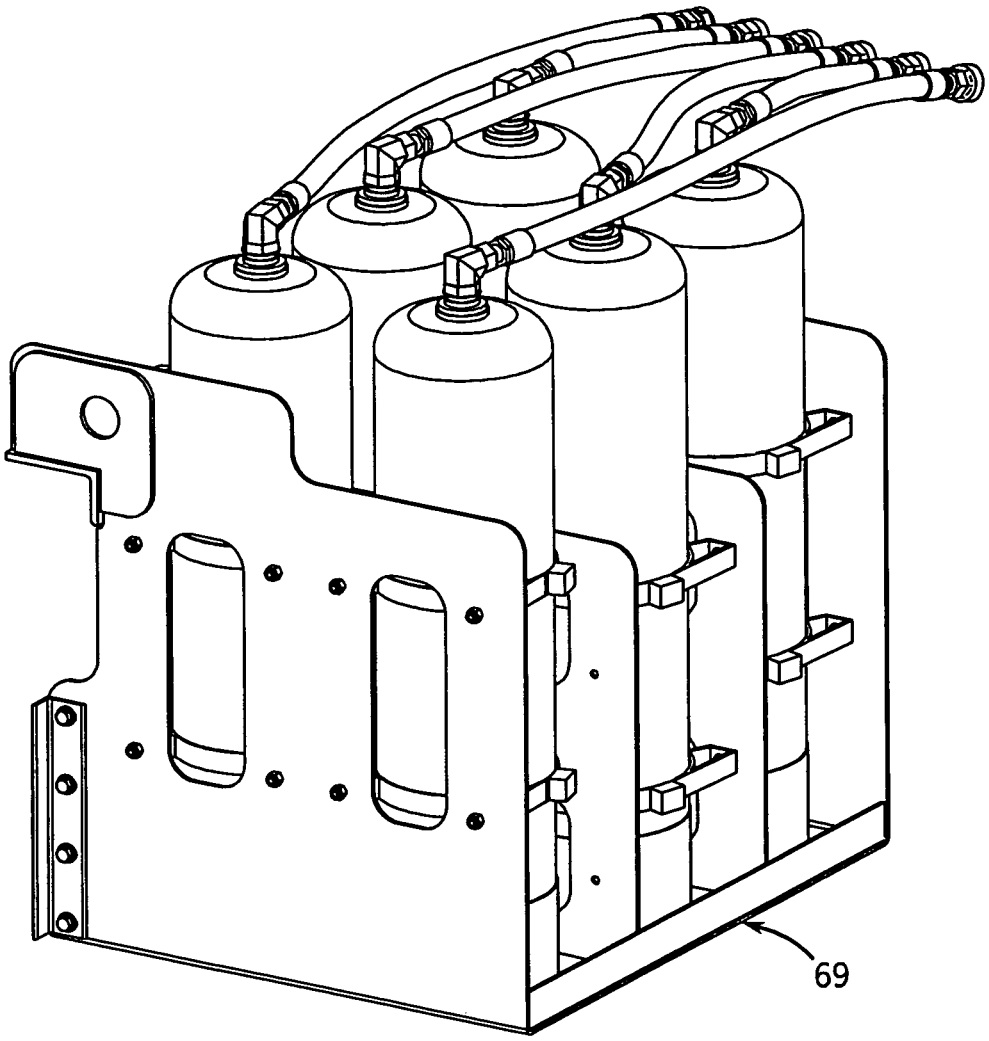
FIG. 7 is a perspective view of the bladder system of the tank system of FIG. 3.

Referring now to FIGS. 6 and 7, a top view of the upper tank 68, and a perspective view of the bladder system 69 are shown, respectively. The air bladder system 69 comprises a plurality of flexible bladders that are connected to an air transfer tube through corresponding hoses. The air transfer tube 71 extends from the upper surface 155 of the tank 68, connecting the tank 68 to the bladder system 69. Air from the bladders 69 is exchanged with air in the upper tank 68 as the oil level rises and falls during operation of the hydraulic components in the system. Therefore, the differential volume is self-contained, rather than exchanged with outside air, limiting the entry of contaminants and moisture into the hydraulic system.

In operation, the reservoir system described above ensures cleanliness of the hydraulic system by minimizing the ingestion of air borne dust and moisture, and by maximizing settling and de-aeration time in the tank system. Oil returned to the upper tank 68 enters a filtration chamber including filtration elements 94, and then through a serpentine flow path as established by baffles 162, 164, 166, 168, 170, and 172. Each of these baffles include openings which are raised above the bottom surface of the tank, and which therefore provide a settling chamber for larger particles, limiting transmission of these particles through the remaining compartments in the tank. The lower tank 70 is similarly divided into compartments by a series of baffles, which provide a relatively long flow path of oil from the inlet 118 to the outlet 116, allowing the oil to de-aerate. The baffles, like in the upper tank 68, include apertures which both direct the flow, and allow contaminants to settle in the lower tank 70.

Cooling efficiency is improved by removing oil from the hottest location in the upper return tank, and running the hot oil through the oil cooler. After passing through the oil cooler, the oil passes through the primary oil filter and then returns it to the final baffled compartment of lower reservoir near the pump suction header. Thus, clean and cool oil is introduced to the oil flow going directly into the pumps.

Although specific embodiments have been shown and described, it will be apparent that a number of variations could be made within the scope of the invention. It should be understood therefore that the methods and apparatuses described above are only exemplary and do not limit the scope of the invention, and that various modifications could be made by those skilled in the art that would fall under the scope of the invention. To apprise the public of the scope of this invention, the following claims are made:

We claim:

1. A tank system defining a fluid chamber for retaining hydraulic fluid used to control one or more hydraulic cylinder in a mining shovel, the tank system comprising:

an upper tank comprising a plurality of baffles partitioning the upper tank into a plurality of compartments, wherein a first baffle includes a first aperture formed within the first baffle and a second baffle includes a second aperture formed within the second baffle, wherein the first and second apertures are configured to direct a flow of fluid through the upper tank, wherein the second baffle extends perpendicular to the first baffle and is positioned downstream of the first baffle such that the first and second apertures form a serpentine flow path having a substantially right angle turn, and wherein the first and second baffles are configured to direct the flow of hydraulic fluid through the serpentine flow path to filter contaminants from and de-aerate the hydraulic fluid;

a lower tank coupled to the upper tank by a transfer pipe; and an expansion bladder, the expansion bladder coupled to the upper tank through an air transfer tube located exterior to the upper tank, wherein air is exchanged between the tank system and the bladder when the cylinder is activated.

2. The tank system as recited in claim 1, wherein the upper tank comprises a return oil filter for filtering oil as it enters the upper tank.

3. The tank system as recited in claim 1, wherein the apertures in the baffles are offset a distance above the bottom surface of the upper tank to filter contaminants from the hydraulic fluids.

4. The tank system as recited in claim 1, wherein the aperture in the first baffle is larger adjacent a top surface of the tank than adjacent a bottom surface of the tank to provide a higher flow rate for the hydraulic fluid at the top of the tank than at the bottom of the tank.

5. The tank system as recited in claim 1, wherein the lower tank comprises a plurality of baffles partitioning the lower tank into a plurality of compartments, wherein at least one of the baffles includes an aperture to direct a flow of fluid through the lower tank.

6. The tank system as recited in claim 5, wherein the aperture in the baffle is offset a distance above the bottom surface of the upper tank to filter contaminants from the hydraulic fluid.

7. The tank system as recited in claim 5, wherein the aperture in the first baffle is larger adjacent a top surface of the tank than adjacent a bottom surface of the tank to provide a higher flow rate for the hydraulic fluid at the top of the tank than at the bottom of the tank.

8. The tank system as recited in claim 1, further comprising a cooler coupled to the upper tank, wherein the cooler receives hot oil from the upper tank and cools the oil.

9. A tank system defining a fluid chamber for retaining hydraulic fluid used to control one or more hydraulic cylinders in a mining shovel, the tank system comprising:

an upper tank comprising an inlet, an outlet, and a plurality of baffles dividing the tank into compartments between the inlet and the outlet, wherein:

a first baffle comprises a first aperture formed within the first baffle for directing a flow of hydraulic fluid between the inlet and the outlet, wherein the first aperture is tapered so that the first aperture is larger adjacent a top surface of the upper tank than adjacent a bottom surface of the upper tank, and wherein the first aperture is offset above the bottom surface and the first baffle extends continuously along the bottom surface to filter contaminants from the hydraulic fluid; and a second baffle comprises a second aperture formed within the second baffle, wherein the second baffle extends continuously along the bottom surface to filter contaminants from the hydraulic fluid, wherein the second baffle extends perpendicular to the first baffle and is positioned downstream of the first baffle such that the first and second apertures form a serpentine flow path having a substantially right angle turn, and wherein the first and second baffles are configured to direct the flow of hydraulic fluid through the serpentine flow path to filter contaminants from and de-aerate the hydraulic fluid; and an expansion bladder, the expansion bladder coupled to the upper tank, wherein air is exchanged between the tank system and the bladder when the cylinder is activated.

10. The tank system as recited in claim 9, further comprising a lower tank fluidly coupled to the upper tank and including an inlet, an outlet, and a plurality of baffles dividing the lower tank into compartments between the inlet and the outlet, and wherein the bladder system is exterior to the upper tank and to the lower tank, and wherein the bladder system is coupled to the upper tank through an air transfer tube.

11. The tank system as recited in claim 10, wherein the baffles in the lower tank and the baffles in the upper tank each include a plurality of apertures, the apertures directing the flow of fluid in an elongate path between an input and an output port in the corresponding tank.

12. The tank system as recited in claim 10, wherein the baffles in the lower tank and the baffles in the upper tank each include apertures that are offset above a lower surface in the respective tank, the apertures filtering contaminants from the hydraulic fluid.

13. A tank system defining a fluid chamber for retaining hydraulic fluid used to control one or more hydraulic cylinders in a mining shovel, the tank system comprising:

an upper tank comprising a plurality of baffles, wherein:

a first baffle comprises a first aperture formed within the first baffle for directing a flow of hydraulic fluid through the upper tank, wherein the first aperture is tapered so that the first aperture is larger adjacent a top surface of the upper tank than adjacent a bottom surface of the upper tank, and wherein the first aperture continuously decreases in width from a top edge adjacent the top surface to a bottom edge adjacent the bottom surface; and a second baffle comprises a second aperture formed within the second baffle, wherein the second baffle extends perpendicular to the first baffle and is positioned downstream of the first baffle such that the first and second apertures form a serpentine flow path having a substantially right angle turn, and wherein the first and second baffles are configured to direct the flow of hydraulic fluid through the serpentine flow path to filter contaminants from and de-aerate the hydraulic fluid; and a cooler system connected to the upper tank, wherein when the hydraulic cylinders are activated, hot oil is returned to the upper tank and is transmitted through the cooler system.

14. The tank system of claim 13, further comprising an expansion bladder, the expansion bladder being coupled to the upper tank through an air transfer tube located exterior to the upper tank, wherein air is exchanged between the tank system and the bladder when the cylinder is activated.

15. The tank system of claim 13, wherein the upper tank comprises a return oil filter for filtering oil as it enters the upper tank.

16. The tank system of claim 13, wherein the upper tank comprises an inlet and an outlet, and wherein the plurality of baffles divides the upper tank into compartments between the inlet and the outlet.

17. The tank system of claim 13, further comprising a lower tank coupled to the upper tank by a transfer tube, and wherein the lower tank comprises an inlet, an outlet, and a plurality of baffles dividing the tank into compartments between the inlet and the outlet, wherein at least one of the baffles comprises an aperture for directing a flow of hydraulic fluid between the inlet and the outlet.

18. The tank system of claim 16, wherein the upper tank comprises a structural box fluidly connected to the inlet for receiving hydraulic fluid directly from the inlet, the structural box comprising a plurality of filter elements extending below the structural box and into one of the compartments of the upper tank, and wherein the plurality of filter elements are configured to remove large particles from hydraulic fluid entering the upper tank.

19. The tank system of claim 13, wherein the upper tank comprises an inlet compartment provided between a first baffle and a second baffle, a middle compartment provided between the second baffle and a third baffle and being fluidly connected to the inlet compartment, and an outlet compartment provided between the third baffle and an end wall of the upper tank and being fluidly connected to the middle compartment, and wherein hydraulic fluid is directed through a serpentine path from the inlet compartment to the middle compartment and to the outlet compartment by the plurality of baffles, filtering contaminants from the hydraulic fluid and de-aerating the hydraulic fluid.

* * * * *